US005554967A

United States Patent [19]

Cook et al.

[11] Patent Number: 5,554,967

[45] Date of Patent: Sep. 10, 1996

[54] REMINDER DEVICE

[75] Inventors: David C. Cook, Wexford, Pa.; Douglas E. Weitzel, Hamilton; Edward T. Hawley, Keyport, both of N.J.

[73] Assignee: SmithKline Beecham Corp., Philadelphia, Pa.

[21] Appl. No.: 272,504

[22] Filed: Jul. 8, 1994

[51] Int. Cl.[6] ..... G08B 1/00; G04B 47/00

[52] U.S. Cl. ..... 340/309.15; 340/309.4; 340/573; 368/1; 368/10; 364/413.02

[58] Field of Search ..... 340/309.14, 309.4, 340/573; 368/1, 10; 364/413.02

[56] References Cited

U.S. PATENT DOCUMENTS

| | | | |
|---|---|---|---|
| 4,258,354 | 3/1981 | Carmon et al. | 340/309.15 |
| 4,293,845 | 10/1981 | Villa-Real | 340/309.15 |
| 4,311,448 | 1/1982 | Strauss | 368/10 |
| 4,361,408 | 11/1982 | Wirtschafter | 368/10 |
| 4,382,688 | 5/1983 | Machamer | 368/10 |
| 4,588,303 | 5/1986 | Wirtschafter et al. | 368/10 |
| 4,626,105 | 12/1986 | Miller | 368/10 |
| 4,768,176 | 8/1988 | Kehr et al. | 368/10 |
| 4,768,177 | 8/1988 | Kehr et al. | 368/10 |
| 4,837,719 | 6/1989 | McIntosh et al. | 364/413.01 |
| 4,849,948 | 7/1989 | Davis et al. | 368/10 |
| 4,853,854 | 8/1989 | Behar et al. | 368/10 |
| 4,942,544 | 7/1990 | McIntosh et al. | 340/309.15 |
| 5,097,429 | 3/1992 | Wood et al. | 368/10 |
| 5,099,463 | 3/1992 | Lloyd et al. | 368/10 |
| 5,289,157 | 2/1994 | Rudick et al. | 368/10 |

*Primary Examiner*—Donnie L. Crosland
*Attorney, Agent, or Firm*—Panitch Schwarze Jacobs & Nadel, P.C.

[57] ABSTRACT

A reminder device for notifying a user when to take a dosage of medication. The credit card size device includes a first time counter for maintaining an elapsed program time and a second time counter for maintaining a current interval time. An alarm notifies the user of the expiration of the current interval. The user takes a dosage of medication in response to the alarm. A switch is provided for resetting the second time counter after the user takes a dosage of medication.

18 Claims, 5 Drawing Sheets

SW2 CHANGE
102
WAKE?
104
NO
YES
SOUND 2 'BLIPS'
106
IDLE
63
SOUND ALARM
108
RESET INTERVAL TIMER
110
CALC NEXT INTERVAL (INTVL)
112
IDLE
63

CHEW INT
90
WAKE?
92
NO
RESET
94
YES
SOUND 'BLIP'
96
RESET INTERVAL TIMER
98
CALCULATE NEXT INTERVAL (INTVL)
100
IDLE
63

REMINDER DEVICE

FIELD OF THE INVENTION

The present invention relates to a reminder device and, more particularly, to a dosage reminder device and a method for reminding a user when to take a dosage of medication.

BACKGROUND OF THE INVENTION

It is now well known that smoking is a leading cause of heart and lung diseases. Indeed warning labels are required on all cigarette packages, cigarette advertising has been banned from the broadcast media, and smoking in public areas, such as airplanes, trains, offices and restaurants is being restricted or banned.

Cigarette smoking causes a physical addiction to nicotine. Accordingly, it is very difficult to quit smoking cigarettes without participating in a smoking cessation program carefully designed to wean a user from the nicotine addiction and the smoking habit. Smoking cessation programs generally last for a specific duration or treatment period and provide a regimen of intervals, of generally increasing duration, at which time the user performs a certain task, such as smoking a cigarette, or having a cigarette substitute. However, it is often difficult for a user to adhere to the program schedule since the time between intervals is generally gradually increasing.

Accordingly, the present invention provides means and methods for a person to more easily adhere to a specific schedule adapted to reduce the user's propensity to smoke.

SUMMARY OF THE INVENTION

Briefly stated, the present invention comprises a reminder device for notifying a user of the expiration of a first predetermined time period and of the expiration of an interval time period. The device comprises first timing means for updating an elapsed interval time, second timing means for updating a current interval time, means for determining and storing a predetermined interval time period, first means for comparing the current interval time to the predetermined interval time period and generating a first compare signal therefrom, second means for comparing the elapsed interval time to the first predetermined time period and generating a second compare signal therefrom, an alarm responsive to the first compare signal for notifying the user that the current interval time is equal to the predetermined interval time period signifying the expiration of the predetermined interval time period, and a first switch for disabling the alarm and signalling the means for determining to determine and store a new predetermined interval time period, reset the current interval time and restart the second timing means.

In addition, the present invention comprises a method of reminding a user when to chew a piece of gum as part of a smoking cessation program, the program being of a fixed length having a predetermined program end point and including a plurality of predetermined intervals, the user chewing a piece of gum upon the expiration of an interval. The method comprises the steps of (a) providing a timing device having an elapsed time counter for continuously maintaining the length of time that the user has been taking part in the smoking cessation program, an interval time counter for maintaining a current interval time, a comparator for determining the expiration of an interval and the expiration of the program, an alarm for notifying the user of the expiration of an interval, and a first switch for resetting the interval time counter and determining a new interval time; (b) initiating device operation by starting the elapsed time counter and the interval time counter; (c) actuating the first switch in response to the alarm notifying the user that an interval has ended, thereby disabling the alarm, resetting the interval time counter and determining a new interval time, the user chewing a piece of gum in response to the alarm; and (d) repeating step (c) until the program has ended.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangement and instrumentality shown. In the drawings.

DETAILED DESCRIPTION OF THE PREFERRED EMBODIMENT

Certain terminology is used in the following description for convenience only and is not limiting. The words "inwardly" and "outwardly" refer to directions towards and away from, respectively, the geometric center of the dosage reminder device and designated parts thereof. The term reset refers to clearing a register or timer so that the register or timer represents a value of zero. The terminology includes the words above specifically mentioned, derivatives thereof and words of similar import.

The reminder device in accordance with the present invention is a timer which can be used for reminding a user to take a dosage of medication at specified intervals. More specifically, the reminder device can be used in connection with a nicotine chewing gum while participating in a smoking cessation program. The smoking cessation program for which the preferred embodiment of the reminder device is used has a duration of twelve weeks and aims to wean a smoker from the desire to smoke a cigarette by substituting a piece of special chewing gum containing nicotine for a cigarette and gradually increasing the time interval between chewing pieces of the gum over the twelve week program period. Thus, the smoking cessation program recognizes that part of a persons addiction to smoking is due to a physical addiction to the nicotine contained in cigarettes. The device informs the user/program participant when to chew a piece of the gum during the smoking cessation program. The time between each dosage (interval time) gradually increases over the twelve-week period (elapsed time), as specified by a particular schedule or algorithm, described in further detail below.

Figure 1:
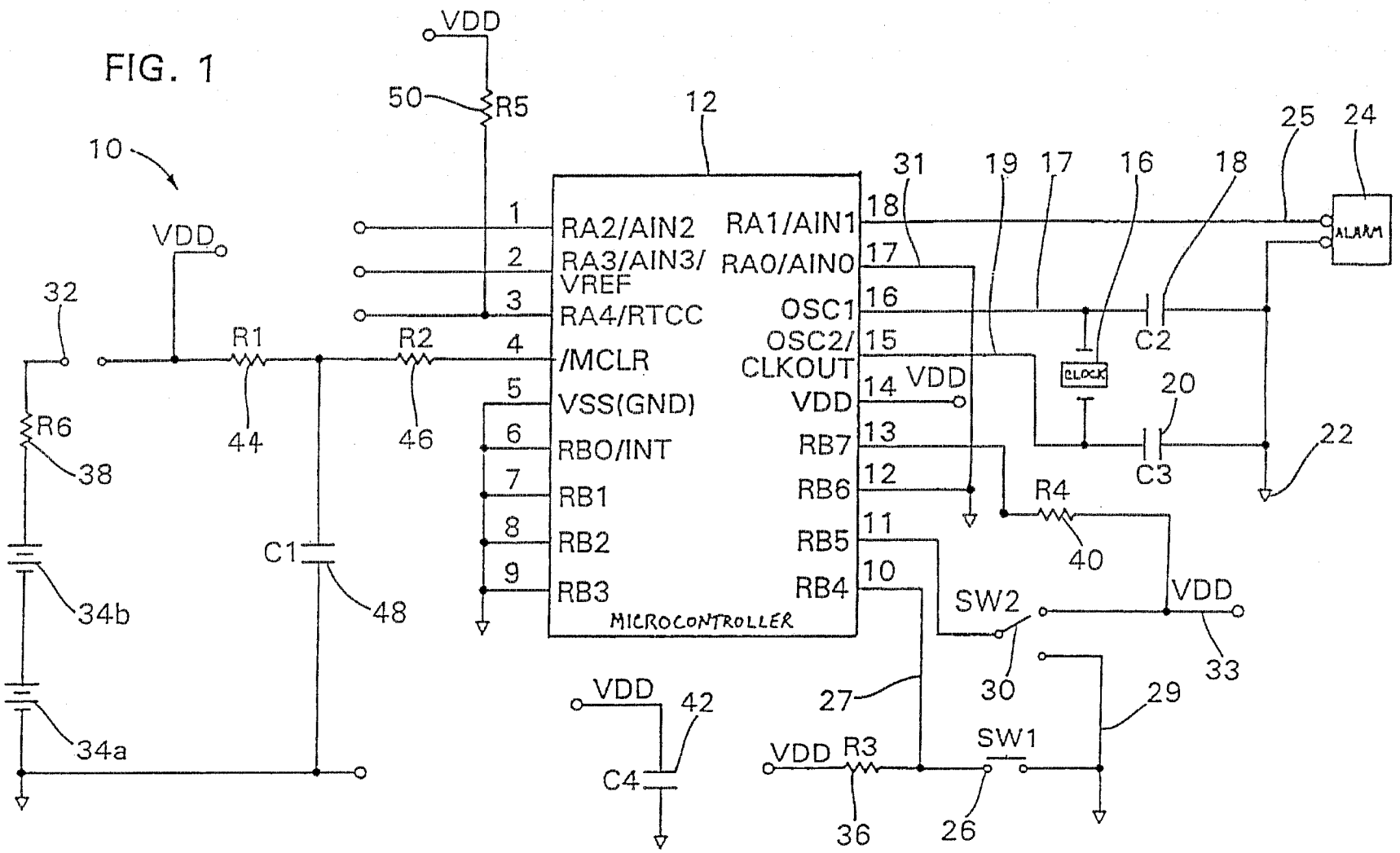
FIG. 1 is a schematic diagram showing an electrical circuit for a reminder device in accordance with the present invention.
Figure 2A:
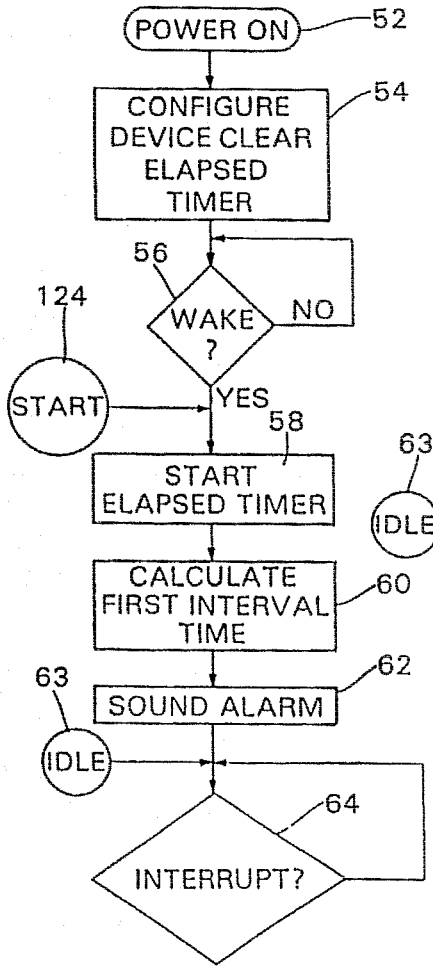
FIGS. 2A–2E are flow diagrams showing the operation of the reminder device of FIG. 1.
Figure 2B:
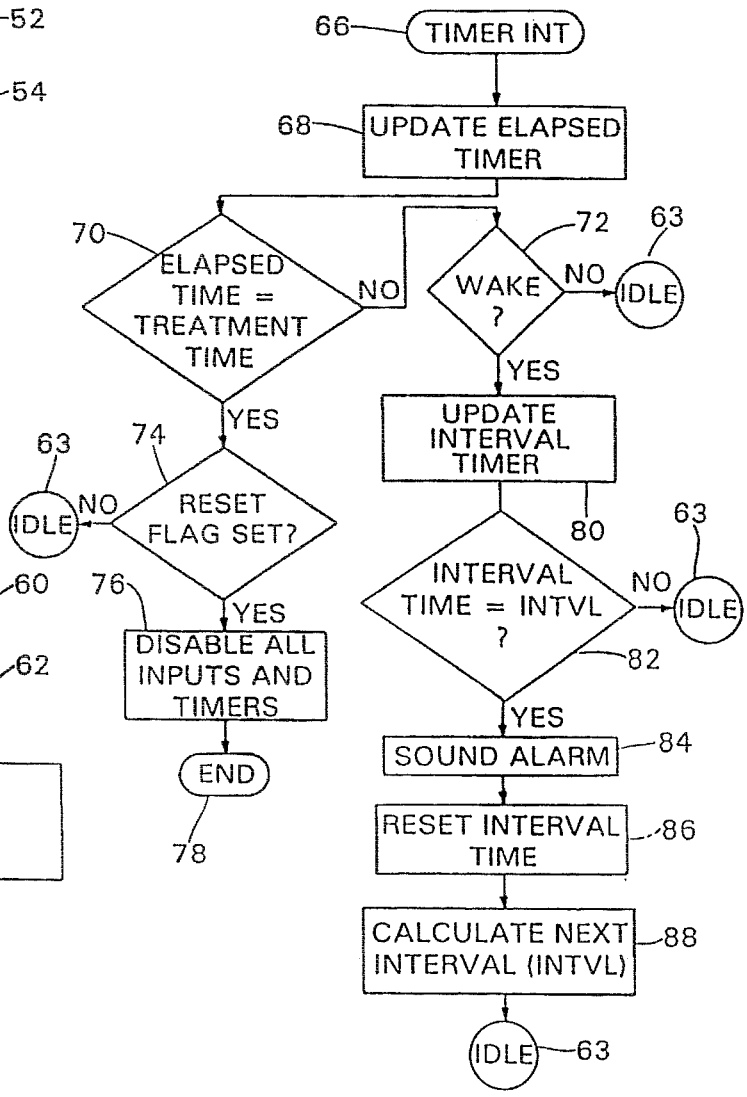
Figures 2C, 2D:
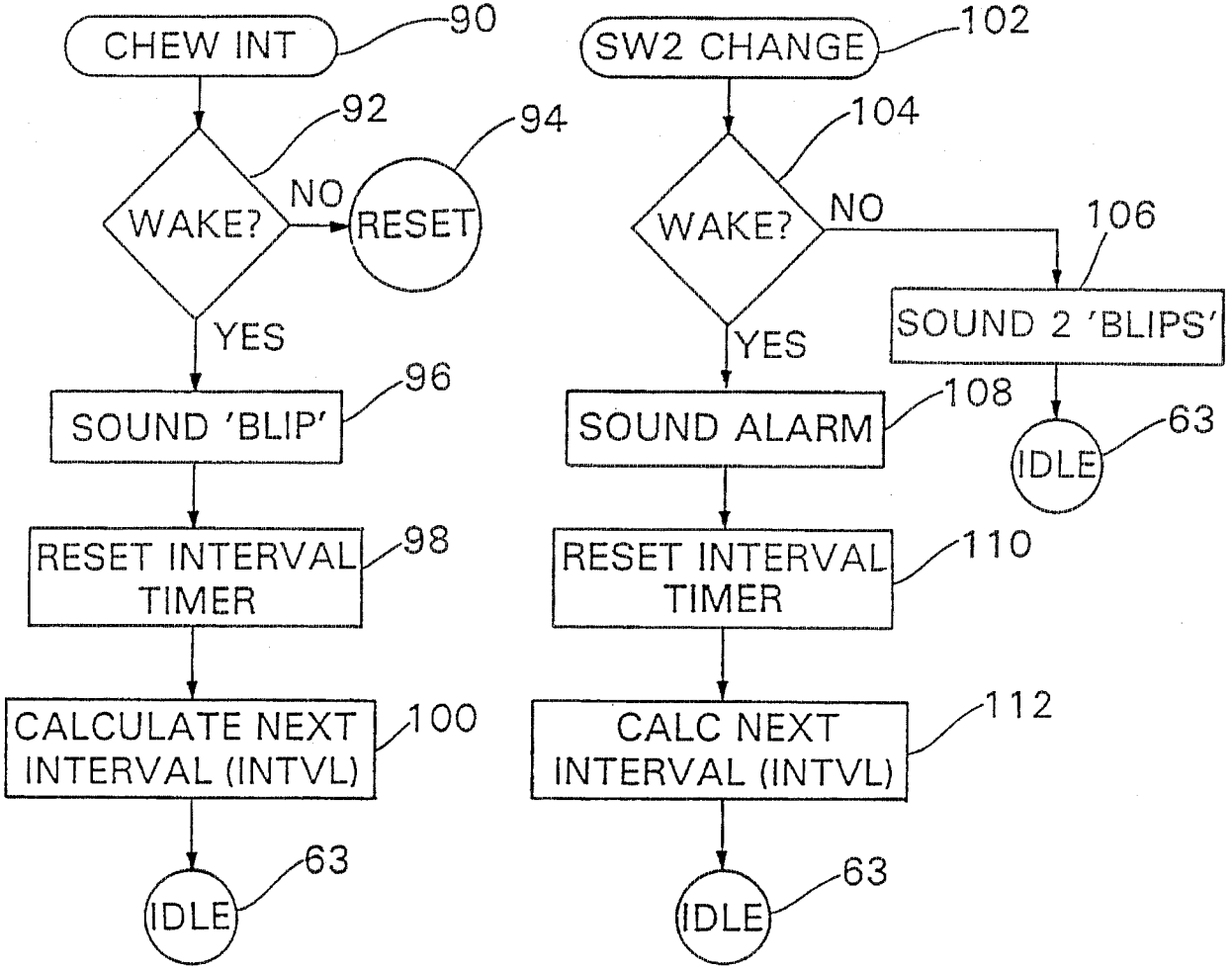
Figure 2E:
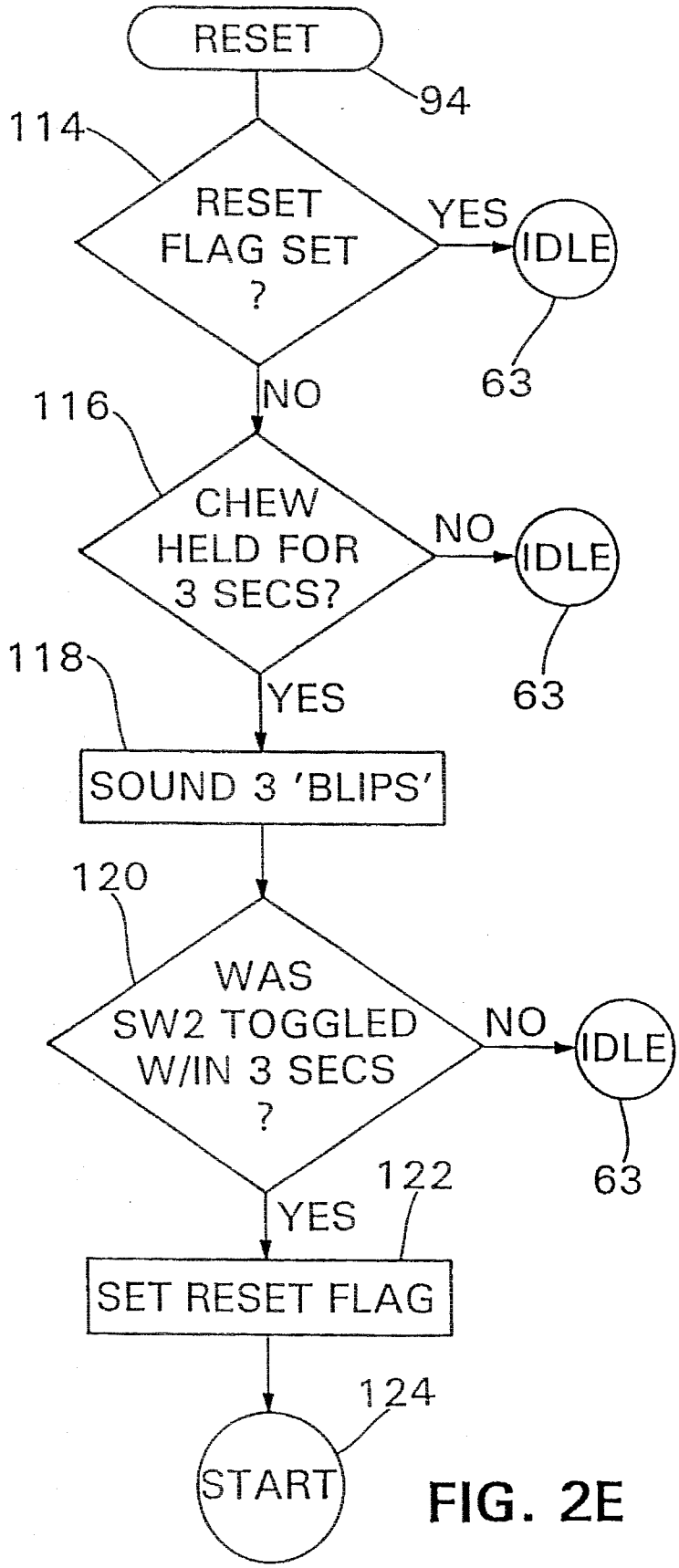
Figure 3:
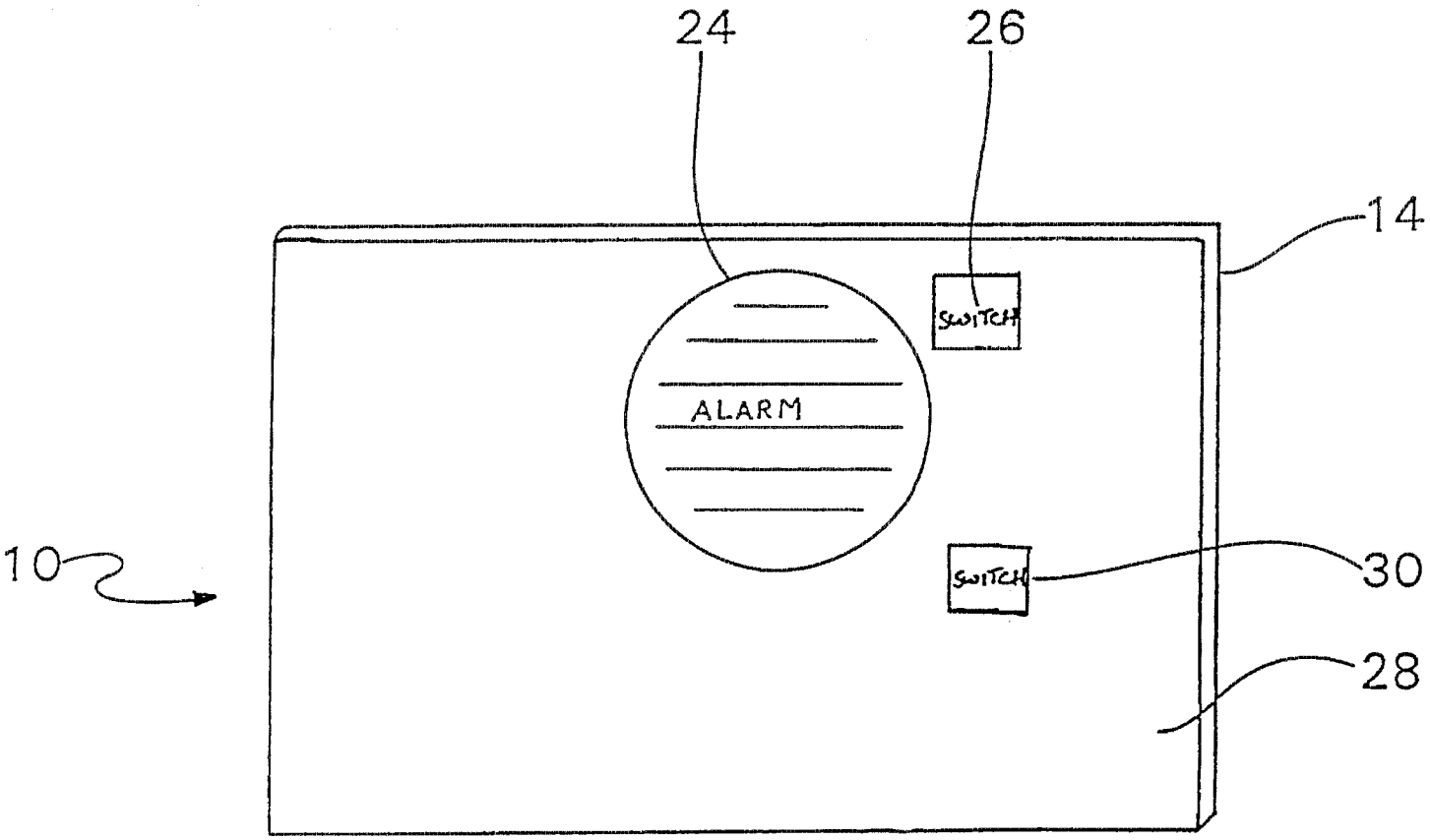
FIG. 3 is a perspective view of preferred mechanical features of the reminder device of FIG. 1.

Referring now to the drawings in detail, wherein like numerals indicate like elements throughout, there is shown in FIGS. 1–3 a presently preferred embodiment of the reminder device, indicated generally at 10. The reminder device 10 ceases to operate and thereby notifies the user of the expiration of a first predetermined time period representative of the program duration. In the preferred embodiment, the program duration is twelve weeks. However, it will be understood by those of ordinary skill in the art from this disclosure that the reminder device 10 can be designed to accommodate other first predetermined time periods, such as 16 weeks, six months, one year, etc. The reminder device 10 also notifies the user of the expiration of an interval time period with an audible signal. The interval time period represents the time between prescribed dosages. As will be seen, the interval time period varies, and in the preferred embodiment, the interval time period gradually increases over the twelve week duration of the smoking cessation program. However, it will be apparent to those of ordinary skill in the art from this disclosure that many variations of interval time periods can be used, such as gradually or rapidly increasing, gradually or rapidly decreasing or constant.

Referring to FIG. 1, a schematic diagram showing a preferred embodiment of an electrical circuit for the reminder device 10 comprises a single chip microcontroller 12 having on-chip memory. In the presently preferred embodiment, the microcontroller 12 is preferably an 8-bit CMOS microcontroller with a 1024×14 on-chip OTPROM, such as the model PIC 16C71 available from Microchip Technology Incorporated of Chandler, Ariz. Details of the structure and operation of the microcontroller 12 are available from the manufacturer and are presented in a handbook provided by the manufacturer. However, other microcontroller chips or discrete hardware can be used to implement the reminder device 10, as will be readily apparent to those of ordinary skill in the art.

The reminder device 10 implemented with the microcontroller 12 has a first timing means for updating an elapsed interval time and a second timing means for updating a current interval time. The first timing means runs continuously, without stopping, from the time that the reminder device 10 is activated until the end of the program (12 weeks). The elapsed interval time is the length of time that the reminder device 10 has been in operation since activated and the current interval time is the length of time since the expiration of a previous predetermined interval or since the activation of the reminder device 10 in the case of the first interval. The elapsed interval time and the current interval time are maintained in separate registers within the microcontroller 12 and are updated every 250 milliseconds internally within the microcontroller 12 by the first and second timing means. The elapsed interval time is maintained in the register in days, hours, minutes and seconds elapsed since activation of the device 10 and the current interval time is maintained in hours, minutes and seconds elapsed since the previous current interval elapsed. Since it is understood by those of ordinary skill in the art how to operate two timers within a microcontroller, this function will not be described further.

The microcontroller 12 is operated in a power saving low frequency (LP) mode. Accordingly, a 32 kHz crystal 16 is connected to the OSC1 input (pin 16) of the microcontroller 12 by way of a conductor 17 and to the OSC2/CLKOUT output (pin 15) of the microcontroller 12 by way of a conductor 19. The 32 kHz crystal 16 is commercially available from a variety of sources and is of a type commonly used in electronically actuated wristwatches. A capacitor 18 ($C_2$) is interconnected between crystal 16 and a common ground point 22 by way of conductor 17 and a capacitor 20 ($C_3$) is interconnected between crystal 16 and the common ground point 22 by way of conductor 19. As specified in the microcontroller 12 handbook, capacitor 18 ($C_2$) and capacitor 20 ($C_3$) are each preferably 15 pF. The crystal 16 and capacitors 18, 20 function to establish oscillation and clock signals for use within the microcontroller 12.

As previously discussed, the reminder device 10 operates for a first predetermined time period, i.e. twelve weeks, which is the preferred length of the smoking cessation program and the predetermined current intervals are predetermined time periods of gradually increasing duration. At the expiration of each current interval, the user is notified that it is time to chew a piece of nicotine containing gum. The microcontroller 12 provides a means for determining and storing a predetermined interval time period. In the presently preferred embodiment, the on-chip OTPROM is used to store a plurality of predetermined interval time periods which are determined based upon how far along the twelve week program the user has progressed. The predetermined interval time periods (in hours) used in the presently preferred embodiment of the invention are shown in Table 1.

TABLE 1

| | DAY 1 | DAY 2 | DAY 3 | DAY 4 | DAY 5 | DAY 6 | DAY 7 |
|---|---|---|---|---|---|---|---|
| WK1 | 1.33 | 1.35 | 1.37 | 1.38 | 1.40 | 1.41 | 1.43 |
| WK2 | 1.45 | 1.46 | 1.48 | 1.50 | 1.51 | 1.53 | 1.54 |
| WK3 | 1.56 | 1.58 | 1.59 | 1.61 | 1.63 | 1.64 | 1.66 |
| WK4 | 1.67 | 1.69 | 1.71 | 1.72 | 1.74 | 1.76 | 1.77 |
| WKS | 1.79 | 1.80 | 1.82 | 1.84 | 1.85 | 1.87 | 1.89 |
| WK6 | 1.90 | 1.92 | 1.93 | 1.95 | 1.97 | 1.98 | 2.00 |
| WK7 | 2.00 | 2.10 | 2.20 | 2.30 | 2.40 | 2.50 | 2.60 |
| WK8 | 2.70 | 2.80 | 2.90 | 3.00 | 3.10 | 3.20 | 3.30 |
| WK9 | 3.40 | 3.50 | 3.60 | 3.70 | 3.80 | 3.90 | 4.00 |
| WK10 | 4.00 | 4.20 | 4.40 | 4.60 | 4.80 | 5.00 | 5.20 |
| WK11 | 5.40 | 5.60 | 5.80 | 6.00 | 6.20 | 6.40 | 6.60 |
| WK12 | 6.80 | 7.00 | 7.20 | 7.40 | 7.60 | 7.80 | 8.00 |

Each of these predetermined interval time periods is stored in a memory location of the OTPROM within the microcontroller 12. For each day of the program, the interval time is the same, e.g. for all of day 2 of week 2 (WK2), the interval time is 1.46 hours. The program starts with a predetermined interval time equal to 1.33 hours and ends with an interval time of 8 hours (day 7 of week 12). For the first six weeks, the program increments the interval time by 0.016 hours each day. For weeks seven to nine, the interval time is incremented by 0.10 hours each day, and for the last three weeks, the interval time is incremented by 0.20 hours per day. Although the reminder device 10 has the specific values shown in Table 1 stored in memory, it will be apparent to those of ordinary skill in the art that other values can be stored in the memory for other programs.

A logic unit within the microcontroller 12 is used for selecting one of the plurality of predetermined interval time periods (table 1) depending upon the current day number, as specified by the elapsed interval time kept by the first timing means. In the presently preferred embodiment, the microcontroller 12 uses the current day number as an index pointer to the one time programmable memory or OTPROM within the microcontroller 12 to locate and fetch one of the predetermined interval time periods. The fetched predetermined interval time period is read from memory and stored in a register for use as described hereinafter. Although the presently preferred embodiment uses a lookup table within the microcontroller 12 internal memory to maintain a plurality of predetermined interval time periods, it should be understood by those of ordinary skill in the art from this disclosure that the predetermined interval time period could be calculated according to a specified algorithm, in which case all of the intervals would not need to reside in internal memory, but could be calculated upon the expiration of the current interval time.

The microcontroller 12 (general registers and arithmetic logic unit) is used as a first means for comparing the current interval time, as maintained by the second timing means, to the predetermined interval time period previously fetched from memory and stored in a register to generate a first compare signal. The microcontroller 12 is also used as a second means for comparing the elapsed interval time, as maintained by the first timing means, to the first predetermined time period (i.e. the program duration of twelve weeks) to generate a second compare signal. It is understood by those of ordinary skill in the art how to program a microcontroller to perform a compare function for generating a signal indicating that the values compared are equal or not equal and, therefore, specifics of the program will not be further described. The first and second compare signals are used to drive the RA1/AIN1 input/output pin (pin 18) of the microcontroller 12 as discussed below.

An alarm 24 responsive to the first compare signal notifies the user that the current interval time is equal to the predetermined interval time period signifying the expiration of the predetermined interval time period. The alarm 24 is connected to the RA1/AIN1 input/output pin (pin 18) of the microcontroller 12 by way of conductor 25 and to the common ground 22. In the preferred embodiment, the alarm 24 comprises a commonly available thin disk type piezo speaker which operates at low power and emits a loud sound. The alarm 24 can be made by the microcontroller 12 to emit, among other tones, a "blip" sound or a "buzz" sound, depending upon the duration and frequency of the signal transmitted over the conductor 25 from the RA1/AIN1 input/output pin. When the second compare signal appears, the elapsed interval time is equal to the first predetermined time period signifying that the twelve week program period is over and operation of the device 10 ceases. Although first and second compare signals have been described, the first and second compare signals can comprise two separate signals driven over the same conductor at different times during program execution. Further, the first and second compare means can comprise the same compare hardware, but again used at different times. The RA0/AIN0 input/output pin (pin 17) of the microcontroller 12 is tied to a common ground by way of a conductor 31 and the RB6 input/output pin (pin 12) of the microcontroller 12 is also tied to ground by the conductor 31.

A first switch 26 is provided for disabling the alarm 24, resetting the current interval time, and fetching a new predetermined interval time. The first switch 26 is connected between the RB4 input/output pin (pin 10) of the microcontroller 12 by way of a conductor 27 and ground by way of a conductor 29. Normally, the RB4 input/output pin is connected to +5 volts ($V_{DD}$) by way of the conductor 27 and a pull-up resistor 36 ($R_3$). When the first switch 26 is actuated, the switch connects the RB4 pin to ground, thereby changing the input on the RB4 pin from a logic 1 to a logic 0. The microcontroller 12 detects the change of state and generates an interrupt, which causes the microcontroller 12 to turn off the alarm, reset the current interval time, and fetch a new predetermined interval time. In the preferred embodiment, the first switch 26 is a push button type switch located on a front face 28 (FIG. 3) of the reminder device 10.

At the end of the current interval time period, as previously described, the microcontroller 12 causes alarm 24 to sound by driving the RA1/AIN1 pin which is connected to the alarm 24. The user is thus notified that it is time to chew a piece of the gum. The user can actuate the first switch 26 to disable the alarm 24 and signal the microcontroller 12 to determine a new predetermined interval time period. As previously discussed, this is done by performing a table or memory lookup using the day number portion of the elapsed time counter maintained by the microcontroller 12. The new predetermined interval time period is then stored in a register, as previously described, the current interval time stored in another register is reset. The second timing means then updates the current interval time every 250 milliseconds, as previously discussed. Since the first switch 26 is to be actuated whenever the user chews a piece of the gum to notify the microcontroller 12 to fetch a new predetermined interval time period and reset the interval time, the first switch 26 is also referred to as the CHEW button.

The reminder device 10 further comprises a second switch 30 for temporarily disabling the alarm 24. In particular, the second switch 30 is actuated when the user is resting, sleeping or for some other reason does not wish to be disturbed by the alarm 24. In the presently preferred embodiment, the second switch 30 is a two position slide type switch located on the front face 28 of the reminder device 10 (FIG. 3). In a first, WAKE position, the second switch 30 connects the RB5 input/output pin (pin 11) of the microcontroller 12 to ground by way of conductor 29. In a second, SLEEP position, the second switch 30 connects the RB5 input/output pin to +5 volts ($V_{DD}$) by way of conductor 33. The RB7 input/output pin (pin 13) of the microcontroller is also connected to +5 volts ($V_{DD}$) by way of conductor 33 and pull-up resistor 40 ($R_4$). Since the second switch 30 is envisioned for use when the user is sleeping, the second switch 30 is referred to as the SLEEP/WAKE switch. Further details of the operation of the CHEW button 26 and the SLEEP/WAKE switch 30 will be described hereinafter in conjunction with the operation of the device 10.

A third switch means 32 is provided for initiating device 10 operation. The third switch 32 means interconnects the microcontroller 12 to a device power source. In the presently preferred embodiment, the device power source comprises two 3 volt thin profile, lithium coin cells **34*a*, 34*b* connected in series. A resistor 38 ($R_6$) and the 3 volt cells 34*a*, 34*b* are connected in series between the third switch means 32 and ground, and provide the $V_{DD}$ input (pin 14) to the microcontroller 12. A decoupling capacitor 42 ($C_4$) is interconnected between $V_{DD}$ and ground. In the presently preferred embodiment, the third switch means 32 comprises a pull tab of a type well known in the art for providing power to the microcontroller 12. When the third switch means 32 is actuated, i.e. pulled, the switch is closed and +5 volts from the power source 34*a*, 34*b* is provided to the $V_{DD}$ input of the microcontroller 12**.

The reminder device 10 also includes external power on reset circuitry to ensure that the microcontroller 12 is clear on start-up (i.e. when the third switch means 32 is actuated). The external power on reset circuitry comprises a first resistor 44 ($R_1$) connected to $V_{DD}$ and a second resistor 46 ($R_2$) connected in series to the first resistor 44 and to the active low MCLR input pin (pin 4) of the microcontroller 12. A capacitor 48 ($C_1$) tied to ground is connected in parallel to the resistors 44, 46 and provides an appropriate delay upon power up to ensure that the microcontroller 12 receives a master clear input.

As previously discussed, the device 10 ceases operating at the end of the first predetermined time period (i.e. the 12 week program time has elapsed). Upon the expiration of the first predetermined time period, the device 10 may be reset and the program restarted. However, in order to prevent continued reuse of the device 10, the device 10 includes a reset flag for preventing the device 10 from being reset and restarted more than one time after the expiration of the first predetermined time period. Operation of the reset flag is discussed hereinafter in further detail in the description of the device 10 operation.

The RA4/RTCC pin (pin 3) of the microcontroller 12 is connected in series to a pull-up resistor 50 ($R_5$), which is connected to +5 volts ($V_{DD}$). The VSS, RB0/INT, RB1, RB2 and RB3 pins (pins 5–9) of the microcontroller 12 are all tied to ground, and the RA2/AIN2 and RA3/AIN3 pins (pins 1–2) of the microcontroller 12 are unused.

As shown in FIG. 3, the device 10 is packaged in a credit-card sized package 14, with the first timing means, second timing means, means for determining and storing, first means for comparing, and second means for comparing all being internal to the microcontroller 12. The credit card size packaging 14 allows the device 10 to easily fit into a shirt pocket, purse, or wallet, or otherwise be easy to carry and unobtrusive to the user participating in the smoking cessation program. Such credit-card sized packaging of electronic devices, such as calculators, storage devices, and smart cards is well known. Moreover, credit-card sized electronic devices may be obtained from a variety of vendors and may include a variety of different electronic components and associated electronic memory, as is well known by those of ordinary skill in the art.

Particulars of operation of the circuitry for the reminder device 10 will now be discussed with reference to FIGS. 2A–2E. The microcontroller 12 contains the timer algorithm and associated software to run the device 10. Referring now to FIG. 2A, the device 10 is started at step 52 by pulling on and removing a pull tab, the third switch 32, to initially connect the power source 34*a*, 34*b* to the microcontroller 12 and by placing the SLEEP/WAKE switch 30 in the WAKE position. Once power is connected to the microcontroller 12, the microcontroller is configured and the timers (i.e. registers) are cleared at step 54. As will be apparent to one of ordinary skill in the art, the microcontroller has a software program stored in memory (OTPROM) and the software is interrupt driven. Timer interrupts occur every 250 milliseconds, while other interrupts, such as a CHEW interrupt (described below) occur as the result of an external event (i.e. the user depressing the CHEW button 26.

After clearing the timers (registers) at step 54, the software checks to determine if the SLEEP/WAKE switch 30 is in the WAKE position at step 56. If the SLEEP/WAKE switch 30 is in the SLEEP position (i.e. connecting microcontroller 12 RB5 pin (pin 11) to $V_{DD}$) then the software repeats step 56 until the position of the SLEEP/WAKE switch 30 is changed to the WAKE position. If, on the other hand, the SLEEP/WAKE switch 30 is in the WAKE position (i.e. connecting microcontroller 12 RB5 pin (pin 11) to ground), then software execution proceeds to step 58. At step 58, the first timing means is started and thereafter the elapsed interval time maintained in the register within the microcontroller 12 is updated every 250 milliseconds.

At step 60, a first predetermined interval time is calculated. As previously discussed, the predetermined interval time is fetched from a lookup table in the microcontroller 12 memory using a portion of the elapsed interval time (i.e., the day number) as an index into the lookup table. At step 62 the alarm 24 emits an audible tone to notify the user that the device has been initialized and is operative. The software then proceeds to an idle loop, indicated at step 63, and repeats step 64, which checks for the occurrence of an interrupt. Some of the interrupts which can occur are a timer interrupt (FIG. 2B) and a CHEW interrupt (FIG. 2C), described in detail below.

FIG. 2B is a flow diagram of a timer interrupt, beginning at step 66. The timer interrupt is generated internally by the microcontroller 12 and occurs every 250 milliseconds. When the timer interrupt occurs, the software proceeds to update the elapsed interval time at step 68 and then compares the elapsed interval time to the first predetermined time period and generates a signal indicative of whether the predetermined time period has expired at step 70. If the result of the comparison performed at step 70 is negative (i.e. the elapsed interval time is less than the first predetermined time period), then execution proceeds with step 72. However, if the elapsed interval time is greater than or equal to the first predetermined time period, execution proceeds with step 74, which checks to determine whether the reset flag has been set. If the reset flag is not set, then the program branches to the IDLE routine, indicated at 63 in FIG. 2A. If the reset flag is set, then execution proceeds with step 76, which disables all inputs and timers so that the reminder device 10 is no longer operable and the program stops, as indicated at 78. This portion of the program prevents the device from being restarted more than once.

At step 72, the software checks to determine the status of the SLEEP/WAKE switch 30. If the switch 30 is in the SLEEP position, then the software branches to the IDLE routine, as indicated at step 63. Thus, it can be seen that when the SLEEP/WAKE switch 30 is in the SLEEP position, then the reminder device does not update the current interval time and will not sound the alarm 24 indicating that the current interval time has ended. However, if the switch 30 is in the WAKE position, then software execution proceeds to step 80, at which time the current interval time is updated. At step 82, the current interval time is compared to the predetermined interval time period (previously fetched from the lookup table) and a signal indicative of whether the predetermined interval time period has expired is generated. If the result of the comparison performed at step 82 is negative (i.e. the current interval time is less than the predetermined interval time period), then execution proceeds by returning to the IDLE routine at step 63. However, if the current interval time is greater than or equal to the predetermined interval time period, execution proceeds with step 84.

At step 84, the software causes the alarm 24 to emit a tone indicating to the user that it is time to chew a piece of the gum. If the CHEW button 26 is not depressed at this time, the reminder device automatically proceeds to step 86 when the alarm 24 stops emitting the tone to reset the current interval time, determine the next predetermined interval time period at step 88, and proceed to the IDLE routine at step 63. The tone emitted by the alarm 24 when the current interval time is greater than or equal to the predetermined interval time period is two long beeps. Each beep has a duration of approximately 150 milliseconds, and is repeated each second for four seconds. It should be noted that the user could cause a CHEW interrupt by depressing the CHEW button 26 at any time, which would cause the software to branch to the CHEW interrupt routine (FIG. 2C) described below.

The CHEW interrupt, indicated at step 90 (FIG. 2C) occurs whenever the user depresses the CHEW button 26. The purpose of the CHEW interrupt is to signal the reminder device 10 to abort the alarm 24, and indicate that the user has taken (chewed) a piece of the gum and that a new predetermined interval time should be fetched and the current interval time reset. The CHEW interrupt routine begins by checking the position of the SLEEP/WAKE switch 30 at step 92. If the SLEEP/WAKE switch 30 is in the SLEEP position, then the software branches to the RESET routine 94, described in further detail below. If the SLEEP/WAKE switch 30 is in the WAKE position, then the software continues with step 96, which causes the alarm 24 to emit a single short "blip" tone indicating to the user that the device 10 has received the CHEW button 26 input. The software then proceeds to step 98 which resets the current interval time and step 100 which determines the next predetermined interval time period. After the next predetermined interval time period has been determined, the software returns to the IDLE routine at step 63.

FIG. 2D illustrates the flow of the software when the SLEEP/WAKE switch 30 is moved, beginning with step 102. When the SLEEP/WAKE switch 30 is moved, the software checks to determine if the switch 30 is in the WAKE position at step 104. If the switch 30 is not in the WAKE position, then the user has just moved the switch 30 from the WAKE position to the SLEEP position, in which case step 106 causes two short "blip" tones to be emitted by the alarm 24 to notify the user that the device is now in a SLEEP mode. In the SLEEP mode, the current interval time is not updated when a timer interrupt occurs (see step 72, FIG. 2B) and accordingly, the current interval does not approach the predetermined interval time period and so the alarm 24 does not sound indicating that the current interval time has expired. This allows the user to sleep or rest without being disturbed by the device 10. However, the elapsed interval time is still continuously updated so that the correct predetermined interval time period is determined when the user returns the device 20 to the WAKE mode.

When the user moves the SLEEP/WAKE switch 30 from the SLEEP to the WAKE position, generally when the user wakes up or is no longer resting, the device 10 by way of the alarm 24 emits a tone at step 108, notifying the user that the switch 30 is in the WAKE position and that the user should chew a piece of the gum. After the alarm 24 sounds (step 108), the current interval time is reset, step 110, and the next predetermined interval time period is determined, step 112. After determining and storing the new predetermined interval time period, the software branches to the IDLE routine, step 63.

The flow of the RESET routine is illustrated in FIG. 2E, as indicated at step 94. The reset routine is executed when the user inputs a predetermined sequence. The device 10 may only be reset once and will abort the RESET routine at step 114 and go to the IDLE routine if the reset flag is set. In order to continue the RESET routine, the predetermined sequence is to verify at 92 that the SLEEP/WAKE switch 30 is in the SLEEP position and then press and hold the CHEW button 26 for approximately three seconds, step 116. If the CHEW button 26 is not held for at least three seconds, the RESET routine is aborted and the software branches to the IDLE routine. If the CHEW button 26 is held for at least three seconds, three "blip" tones are emitted by the alarm 24 to confirm that the CHEW button 26 was held for at least three seconds. Next, while holding the CHEW button 26, the user must toggle the SLEEP/WAKE switch 30 to WAKE, then SLEEP within three seconds after the triple "blip" tone. The RESET routine checks to make sure that the SLEEP/WAKE switch 30 was toggled within three seconds at step 120. If the SLEEP/WAKE switch 30 was not toggled within three seconds, the RESET routine is aborted and the software branches to the IDLE routine, otherwise, the software proceeds to step 122, which sets the reset flag, and then branches to START, indicated at 124, which begins with step 58.

In conjunction with the reminder device 10, the present invention also provides a smoking cessation program comprising a predetermined amount of nicotine chewing gum and the reminder device 10 for notifying a user when to chew a piece of the chewing gum and of the expiration of a first predetermined time period (i.e. the program end point). As previously discussed, the device 10 ceases operating at the end of the first predetermined time period and includes a reset flag for preventing the device 10 from being reset and restarted more than one time after the device 10 ceases operating.

The present invention also includes a method of reminding a user when to chew a piece of nicotine containing gum as part of a smoking cessation program. The program is of a fixed length and has a predetermined program end point. A plurality of predetermined intervals are included for notifying the user when a piece of gum should be chewed. The first step in the method is to provide the reminder device 10, which has an elapsed time counter for continuously maintaining the length of time that the user has been taking part in the smoking cessation program, an interval time counter for maintaining a current interval time, a comparator for determining the expiration of an interval and the expiration of the program, an alarm for notifying the user of the expiration of an interval, and a first switch for resetting the interval time counter and determining a new interval time.

The second step in the method is for the user to initiate the device 10 operation by starting the elapsed time counter and the interval time counter. The user is to actuate the first switch 26 in response to the alarm 24 notifying the user that an interval has ended. Actuating the first switch 26 disables the alarm 24, resets the interval time counter and determines a new interval time. At this point, the user chews a piece of the gum in response to the alarm 24 sounding. The smoking cessation program continues by repeating the second step until the program has ended.

The method can also include the step of temporarily disabling the interval time counter when the user is resting or sleeping. Moreover, if upon expiration of the program the user desires to participate in the program a second time, the user can reset the device 10. However, the device 10 includes a reset flag so that the device 10 can only be used two times.

Although the foregoing invention has been described in conjunction with a particular smoking cessation program, the device 10 can be used in conjunction with other regimens without departing from the scope of the invention.

From the foregoing description, it can be seen that the present invention provides a reminder device for notifying a user when to perform an action, i.e. take a dosage of medication. The reminder device 10 is used for notifying a user when to chew a piece of gum in lieu of smoking a cigarette, as part of a smoking cessation program. The reminder device 10 provides a practical and easy means for maintaining a scheduled program. Further, the reminder device 10 can be easily and efficiently manufactured. Although the reminder device 10 has been described for use in connection with a smoking cessation program, it is understood that the device can be used in connection with other programs in which it would be convenient to have an electronic reminder. Thus, it will be appreciated that changes and modifications may be made to the above described embodiment without departing from the inventive concept thereof. Therefore, it is understood that the present invention is not limited to the particular embodiment disclosed, but is intended to include all modifications and changes which are within the scope and spirit of the invention as defined by the appended claims.

We claim:

1. A reminder device for notifying a user of the expiration of a first predetermined time period and of the expiration of an interval time period, the device comprising:

a first timer for updating an elapsed interval time;

a second timer for updating a current interval time;

a memory for storing a plurality of predetermined interval time periods, said predetermined interval time periods being of generally increasing duration;

a logic unit for selecting one of said plurality of predetermined interval time periods;

a register for storing said selected one of said plurality of predetermined interval time periods;

a first comparator for comparing the current interval time to said selected one of said plurality of predetermined interval time periods and generating a first compare signal therefrom;

a second comparator for comparing the elapsed interval time to the first predetermined time period and generating a second compare signal therefrom to cease operation of the device when the elapsed interval time and the first predetermined time period are the same;

an alarm responsive to the first compare signal for notifying the user that the current interval time is equal to said selected one of said predetermined interval time periods signifying the expiration of said predetermined interval time period; and a first switch for disabling the alarm and signalling the logic unit to select one of said predetermined interval time periods and store said selected predetermined interval time period in said register, reset the current interval time and restart the second timer.

2. A reminder device for notifying a user of the expiration of a first predetermined time period and of the expiration of an interval time period, the device comprising:

first timing means for updating an elapsed interval time;

second timing means for updating a current interval time;

means for determining and storing a predetermined interval time period;

first means for comparing the current interval time to the predetermined interval time period and generating a first compare signal therefrom;

second means for comparing the elapsed interval time to the first predetermined time period and generating a second compare signal therefrom to cease operation of the device when the elapsed interval time is the same as the first predetermined time period;

an alarm responsive to the first compare signal for notifying the user that the current interval time is equal to the predetermined interval time period signifying the expiration of the predetermined interval time period; and a first switch for disabling the alarm and signalling the means for determining to determine and store a new predetermined interval time period, reset the current interval time and restart the second timing means.

3. The apparatus of claim 2 wherein the device further comprises a reset flag for preventing the device from being reset and restarted more than one time after the expiration of the first predetermined time period.

4. The apparatus of claim 2 further comprising a second switch for temporarily disabling the alarm.

5. The apparatus of claim 2 further comprising a third switch means for initiating device operation.

6. The apparatus of claim 5 wherein the third switch means comprises a pull tab for interconnecting a device power source to the device.

7. The apparatus of claim 2 wherein the means for determining and storing the predetermined interval time period comprises a lookup table stored in the apparatus, the lookup table comprising a plurality of interval time periods of successively longer duration.

8. The apparatus of claim 7 wherein at least a portion of the elapsed interval time is used as an index pointer for pointing to a location in the lookup table, said location containing the predetermined interval time period.

9. The apparatus of claim 2 wherein the device is packaged in a credit-card sized package and the first timing means, second timing means, means for determining and storing, first means for comparing, and second means for comparing comprise a microprocessor with a preprogrammed memory.

10. A smoking cessation program comprising:

a predetermined amount of nicotine chewing gum; and a reminder device for notifying a user when to chew a piece of said chewing gum and of the expiration of a first predetermined time period, said reminder device further comprising:

first timing means for updating an elapsed interval time;

second timing means for updating a current interval time;

means for determining and storing a predetermined interval time period;

first means for comparing the current interval time to the predetermined interval time period and generating a first compare signal therefrom;

second means for comparing the elapsed interval time to the first predetermined time period and generating a second compare signal therefrom and for ceasing operation of the device when the elapsed interval time is the same as the first predetermined time period;

an alarm responsive to the first compare signal for notifying the user that the current interval time is equal to the predetermined interval time period signifying the expiration of the predetermined interval time period, thereby notifying the user to chew a piece of said chewing gum; and a first switch for disabling the alarm and signalling the means for determining to determine and store a new predetermined interval time period, reset the current interval time and restart the second timing means.

11. The apparatus of claim 10 wherein the device further comprises a reset flag for preventing the device from being reset and restarted more than one time after the device ceases operating.

12. The apparatus of claim 10 further comprising a second switch for temporarily disabling the alarm.

13. The apparatus of claim 10 further comprising a third switch means for initiating device operation.

14. A method of reminding a user when to chew a piece of gum as part of a smoking cessation program, the program being of a fixed length having a predetermined program end point and including a plurality of predetermined intervals, the user chewing a piece of gum upon the expiration of an interval, the method comprising the steps of:

(a) providing a timing device having an elapsed time counter for continuously maintaining the length of time that the user has been taking part in the smoking cessation program, an interval time counter for maintaining a current interval time, a comparator for determining the expiration of an interval and the expiration of the program, an alarm for notifying the user of the expiration of an interval, and a first switch for resetting the interval time counter and determining a new interval time;

(b) initiating device operation by starting the elapsed time counter and the interval time counter;

(c) actuating the first switch in response to the alarm notifying the user that an interval has ended, thereby disabling the alarm, resetting the interval time counter and determining a new interval time, the user chewing a piece of gum in response to the alarm; and (d) repeating step (c) until the comparator determines the expiration of the program, thereby signifying that the program has ended.

15. The method of claim 14 wherein the timing device further comprises a second switch for temporarily disabling the alarm, the method further comprising the step of actuating the second switch to temporarily disable the interval time counter.

16. The method of claim 14 further comprising the step of resetting the device after the program has ended for initiating a new program, wherein resetting the device causes a reset flag to be set so that the device cannot be reset more than once.

17. The method of claim 14 wherein the piece of gum contains nicotine.

18. A method of reminding a user when to take a dosage of medication over a predetermined time period, the time period being of a fixed length having a predetermined end point and including a plurality of predetermined intervals, the user taking a dosage of medication upon the expiration of an interval, the method comprising the steps of:

(a) providing a timing device having an elapsed time counter for continuously maintaining the time from inception of the predetermined time period, an interval time counter for maintaining an interval time, comparator means for determining the expiration of an interval and the expiration of the program, an alarm for notifying the user of the expiration of an interval, and a first switch for resetting the interval time counter and determining a new interval time and a second switch for disabling the alarm;

(b) initiating device operation by starting the elapsed time counter and the interval time counter;

(c) actuating the first switch in response to the alarm notifying the user that an interval has ended, thereby disabling the alarm, resetting the interval time counter and determining a new interval time, the user taking a dosage of medication in response to the alarm; and (d) repeating step (c) until the comparator determines the expiration of the program, thereby signifying that the program has ended.

* * * * *